US010392766B2

(12) United States Patent
Hamling

(10) Patent No.: US 10,392,766 B2
(45) **Date of Patent: *Aug. 27, 2019**

(54) METHOD AND APPARATUS FOR REAL-TIME ADJUSTMENT OF THE SIZE AND DRAINAGE TILE CAPACITY OF DRAINAGE TILE SPOOLS AND FOR UTILIZING THE SAME

(71) Applicant: Heavy Metals, Inc., Vinton, IA (US)

(72) Inventor: Mark Hamling, Vinton, IA (US)

(73) Assignee: Heavy Metals, Inc., Vinton, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/165,081

(22) Filed: Oct. 19, 2018

(65) Prior Publication Data

US 2019/0048547 A1 Feb. 14, 2019

Related U.S. Application Data

(63) Continuation of application No. 14/884,509, filed on Oct. 15, 2015, now Pat. No. 10,125,463.

(60) Provisional application No. 62/064,789, filed on Oct. 16, 2014.

(51) Int. Cl.

| | |
|---|---|
| ***E02B 11/00*** | (2006.01) |
| ***E02D 19/22*** | (2006.01) |
| ***E02D 31/10*** | (2006.01) |
| ***E02F 3/00*** | (2006.01) |

(52) U.S. Cl.

CPC ..... *E02B 11/005* (2013.01); *E02D 19/22* (2013.01); *E02D 31/10* (2013.01); *E02F 3/00* (2013.01)

(58) Field of Classification Search

CPC combination set(s) only.

See application file for complete search history.

(56) References Cited

U.S. PATENT DOCUMENTS

| | | | |
|---|---|---|---|
| 3,880,305 | A | 4/1975 | Van Polen |
| 4,003,122 | A | 1/1977 | Overmyer et al. |
| 4,049,140 | A | 9/1977 | Roose |
| 4,148,399 | A | 4/1979 | Carter et al. |
| 4,473,196 | A | 9/1984 | Sammann et al. |
| 4,555,073 | A | 11/1985 | Barazone |
| 4,664,332 | A | 5/1987 | Barazone |
| 4,699,330 | A | 10/1987 | Barazone |
| 4,705,229 | A | 11/1987 | Barazone |
| 4,742,970 | A | 5/1988 | Barazone |
| 4,754,815 | A | 7/1988 | Brouwer et al. |
| 4,878,542 | A | 11/1989 | Brouwer et al. |
| 5,839,514 | A | 11/1998 | Gipson |
| 5,988,555 | A | 11/1999 | Unruh et al. |
| 6,042,328 | A | 3/2000 | McVaugh |
| 6,220,811 | B1 | 4/2001 | Bernecker |
| 6,299,094 | B1 | 10/2001 | James |
| 6,332,627 | B1 | 12/2001 | Damron |
| 6,394,732 | B1 | 5/2002 | Sweezey |
| 6,543,713 | B1 | 4/2003 | Frolander et al. |

(Continued)

*Primary Examiner* — Kyle Armstrong

(74) *Attorney, Agent, or Firm* — Simmons Perrine Moyer Bergman PLC

(57) ABSTRACT

A drainage tile stringer system which includes a spool which has an automated hat, which translates along the stinger or shaft of the spool so that the vertical size of the spool is adjustable to accommodate differences in coils of drainage tiles. The system is automated so that a single controller can be utilized to perform all of the hydraulic functions required to load a coil onto the drainage tile stringer system and to adjust the vertical spool dimension.

16 Claims, 9 Drawing Sheets

(56) References Cited

U.S. PATENT DOCUMENTS

| | | | |
|---|---|---|---|
| 6,575,393 | B1 | 6/2003 | James |
| 6,983,953 | B1 | 1/2006 | Damron |
| 7,464,894 | B1 | 12/2008 | Himmelberg |
| 7,494,087 | B2 | 2/2009 | McVaugh |
| 7,810,574 | B2 | 10/2010 | Stukey et al. |
| 8,079,799 | B2 | 12/2011 | Rathbun et al. |
| 2010/0314482 | A1 | 12/2010 | Merkt |
| 2013/0277488 | A1 | 10/2013 | Hovland |

METHOD AND APPARATUS FOR REAL-TIME ADJUSTMENT OF THE SIZE AND DRAINAGE TILE CAPACITY OF DRAINAGE TILE SPOOLS AND FOR UTILIZING THE SAME

CROSS REFERENCE TO RELATED APPLICATIONS

The present application is a continuation of and claims the benefit of the filing date of non-provisional patent application having Ser. No. 14/884,509 filed on Oct. 15, 2015 and the filing date of provisional patent application having Ser. No. 62/064,789 filed on Oct. 16, 2014 by the same inventor, which applications are incorporated herein in their entirety by this reference.

FIELD OF THE INVENTION

The present invention generally relates to agricultural machinery and soil drainage. More specifically, the present invention pertains to a new drain tile roll support and loading apparatus for replacing and dispensing drain tile rolls while in the field.

BACKGROUND OF THE INVENTION

Tile drainage is a subsurface water control means often utilized in agricultural settings for improvement of moisture levels within the soil. Moisture content within the soil is often controlled in order to improve crop growth and for allowing access to the crops by way of heavy farm equipment. Too much moisture in the soil inhibits plant growth, and heavily saturated soil can quickly bog down heavy machinery utilized in crop cultivation, making access difficult.

Tile drainage has been performed with a buried drain pipe that is either segmented or perforated to accept therein subsurface water, wherein the buried drain is graded such that the water naturally flows in one direction and into a surface water collection area, such as a nearby body of water or a man-made reservoir. The drain tile is an elongated section of pipe that is buried within an excavated trench within the soil, in a similar fashion as a French drain around buildings, wherein the drain tile is then optionally covered with gravel and then a layer of soil thereover. As the water level rises, or as water percolates into the soil from rainfall, the water enters the pipe and flows from the farm fields and away from the crops, which desire a specific range of moisture levels in order to ensure proper root growth for healthy development.

Deploying drain tile, or "stringing" tile, involves placement of a drain tile piping roll onto a tractor or similar article of farm machinery for support thereof. Workmen may draw the tile from a spool supporting the roll as the tractor advances along a desired path for the drain tile trench. The spool rotates and the length of tile is withdrawn from the roll for placement into the trench before backfilling with soil thereover. The roll is therefore rotatably supported by the tractor to facilitate withdrawing therefrom, while periodic replacement of the roll is required after its drain tile length is fully deployed. In the past, when replacing the roll of drainage tile, the operator had to position a new roll onto a spool shaft and secure the roll thereto using an upper and lower spool ring that ensures the roll does not slide from the spool during operation. During the process of stringing tile in the field, operators were often required to exit the vehicle cab in which they are loading a fresh roll of drain tile onto the spool shaft or when unloading a depleted roll therefrom. This process was time-consuming and inefficient to the overall tile stringing process.

The replacement process further allowed for steps to be skipped that affect safety of the operators and workers in the field. During replacement of the roll, both rings of the spool were often required to be installed to contain the roll thereon. If operators choose not to install the removable top ring, the tile might dislodge from the spool and flip over as it is being unrolled, which could cause defects in the pipe. The tile might also bounce along the spool shaft while in the field, causing damage to the spool, the tile, and the trailer. It has been submitted in the past that an effective solution to these known problems was necessary. A solution was proposed in U.S. patent application Ser. No. 13/866,263, Publication No. 20130277488 (published Oct. 24, 2013) (Paul Hovland, applicant), which patent application is incorporated herein in its entirety by this reference. This system utilizes a pivoting rocker arm 20 for placing the cap, which provides for only a single location of the upper ring 13 when it is oriented to be opposing the ring 12. Additionally, the system refers to controls in the vehicle and shows multiple sets of hydraulic hoses, which suggest a configuration where there is the capability for independent manual cylinder control for each hydraulically adjusted portion of the implement.

The present invention pertains to an automatic apparatus for and method of placing and replacing rolls of drainage tile onto a mobile spool of a hydraulic tile stringing implement, and for adjusting the vertical size of the spool during removal of the tile from the spool.

Consequently, there exists a need for improved methods and apparatuses for efficiently deploying rolls of drainage tiles.

SUMMARY OF THE INVENTION

It is an object of the present invention to provide an easily implemented efficient system and method for placing and replacing rolls of drainage tiles.

It is a feature of the present invention to utilize a fully automated system for control of a tile stringing implement from within the vehicle.

It is an advantage of the present invention to provide for a reduction in time necessary to load and deploy a roll of drainage tile on a tile stringing implement.

It is another object of the invention to reduce the potential for unwanted movement of tile within the spool while tile is being removed from the spool.

It is another feature to provide a vertically adjustable height of the hat of the spool to make the vertical size of the spool variable to reflect variations in coiling of the tile, construction of the tile and even during dispensing of the tile with the declining amount of tile remaining on the spool. Hat travel when capping a coil is often limited by both the surface of the coil end as well as a "core". The core is a larger diameter plastic tile sleeve the same width as the coil, onto which the tile is wrapped at the manufacturer. Thus, the hat has limited travel even when the amount of tile is declining. However, the fresh coil ends are sometimes uneven (nonplanar) with bulging internal coil loops. The present invention is often capable of compressing this to a planar surface. However, if it cannot, then it has the ability to preload down pressure and urge it to become planar as the tile is unwound.

It is another advantage of the present invention to reduce the freedom for unwanted motion of the tile while on the spool.

The present invention is an apparatus and method for efficiently and cost effectively deploying rolls of drainage tiles in the field.

Accordingly, the present invention is a method of adjusting a spool size for a coil of drainage tile on a drainage tile stringing implement attachment comprising the steps of: providing a coil of an elongated drainage tile, said coil having a first height characteristic; providing a spool shaft oriented in a first direction and said coil being disposed about said spool shaft; providing a first spool end drainage tile retaining member, coupled to said spool shaft; providing a second spool end drainage tile retaining member; providing a spool shaft receiving member coupled to said second spool end drainage tile retaining member; translating said second spool end drainage tile retaining member in a second direction, which is substantially parallel with said first direction.

BRIEF DESCRIPTION OF THE DRAWINGS

The invention may be more fully understood by reading the following description of the preferred embodiments of the invention, in conjunction with the appended drawing wherein.

DETAILED DESCRIPTION

Although described with particular reference to three point hitch implement, the system and method for tile stringing can be implemented in with many different types of devices, the particular implement shown here is merely an example of the many other implements that could utilize the present invention. The materials and construction techniques used in the fabrication of the present invention are common and well known in the art of agricultural implements. A person skilled in the art of design and fabrication of agricultural implements would readily understand how to make and use this invention after reading this application and viewing the drawings.

Figure 1:
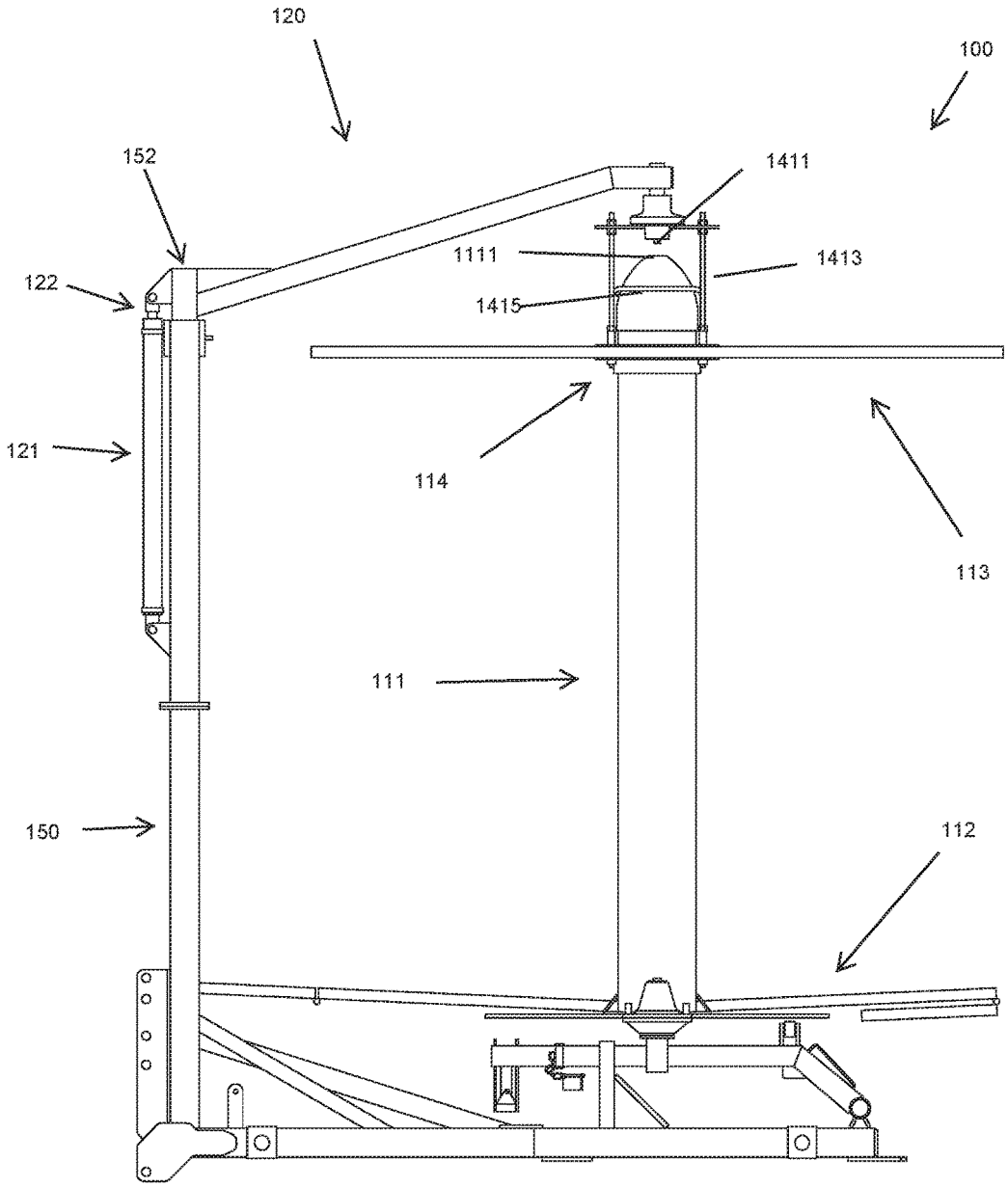
FIG. 1 is an elevation view of the drainage tile stringing implement attachment 100 of the present invention, shown in an empty and mostly vertical compact configuration.
Figure 2:
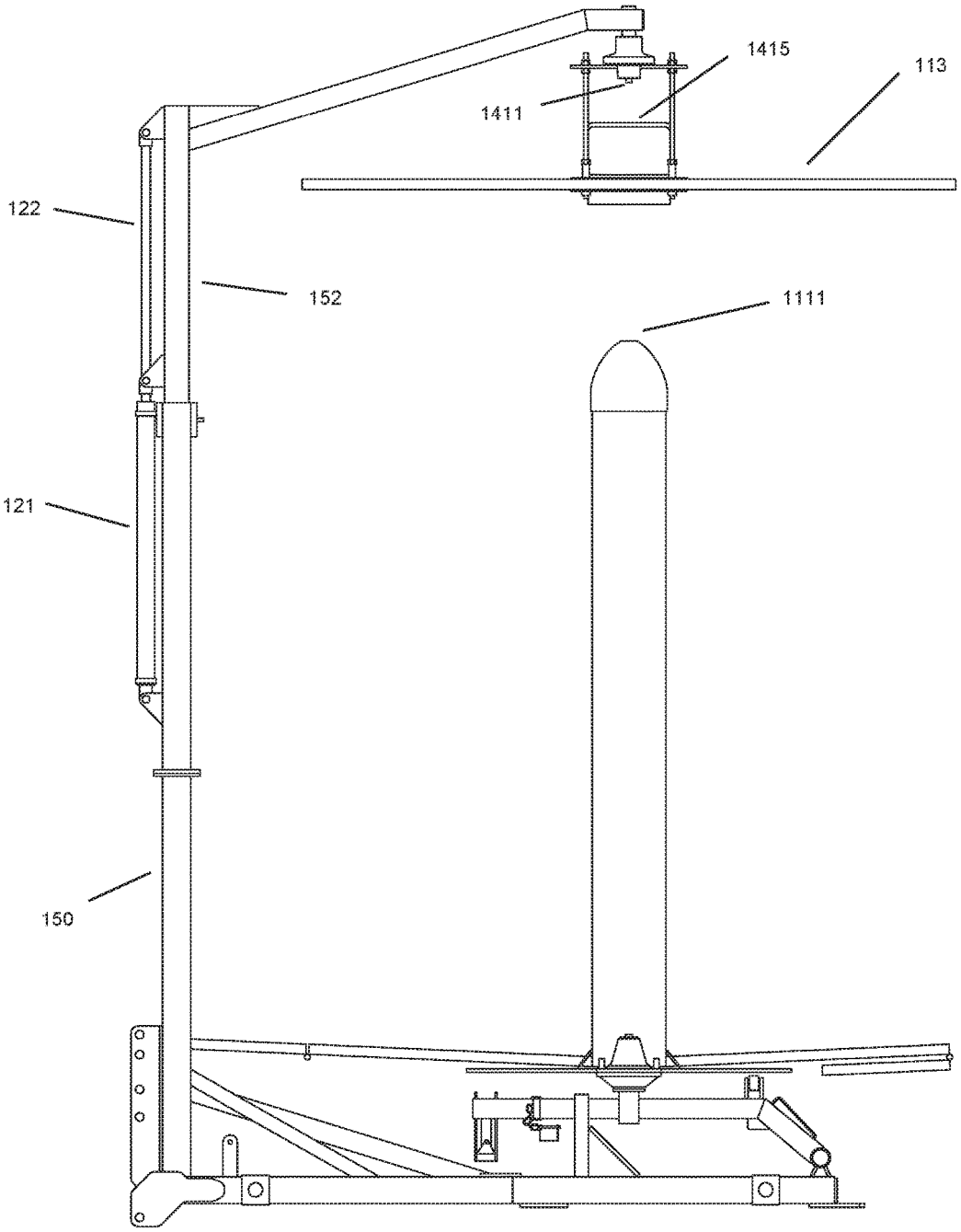
FIG. 2 is an elevation view of the drainage tile stringing implement attachment 100 of FIG. 1 in an empty and less vertically compact configuration.
Figure 3:
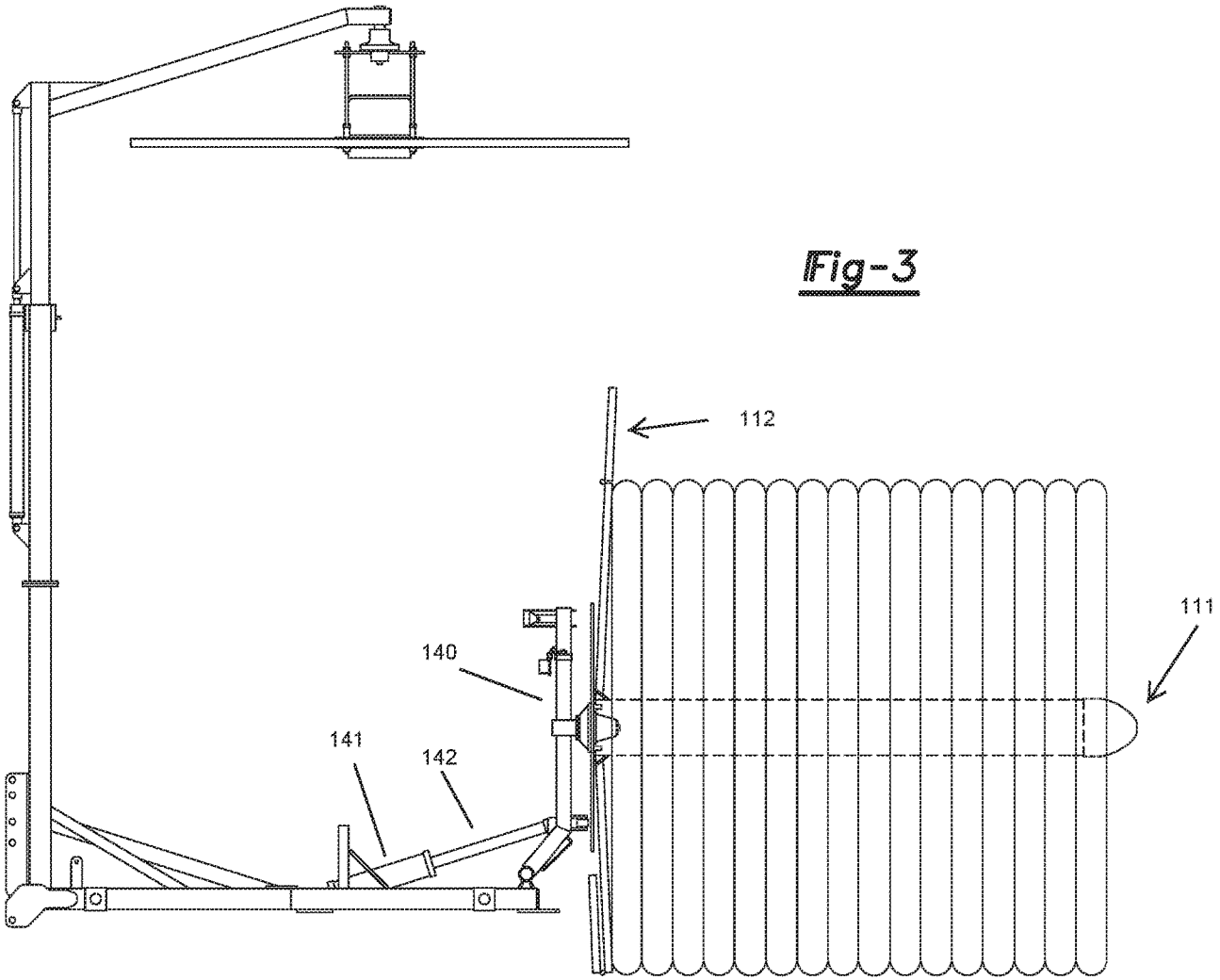
FIG. 3 is an elevation view of the drainage tile stringing implement attachment 100 of FIGS. 1 and 2 in a coil engaging configuration.

Now referring to the Figures, wherein like numerals refer to like matters throughout, and more particularly referring to FIG. 1, there is shown a drainage tile stringing implement attachment 100 of the present invention, it is not shown attached to any type of vehicle but this embodiment may be attached to a three point hitch trailer of the type commonly pulled by tractors. However, drainage tile stringing implement attachment 100 could be attached to a regular automotive trailer, a truck, a UTV, an ATV, a cart, or the like. Drainage tile stringing implement attachment 100 is shown having a spool shaft 111, a first spool end drainage tile retaining member 112 and a second spool end drainage tile retaining member 113, where the spool shaft 111 extends between the first spool end drainage tile retaining member 112 and the second spool end drainage tile retaining member 113. These items may be, but need not be, similar to items 11, 12 and 13, respectively, in the above referenced published US Patent Application. Spool shaft 111 is shown in a generally upright position and having a shaft longitudinal axis which is shown as being temporarily substantially vertical. First spool end drainage tile retaining member 112 coupled to and disposed about spool shaft 111 and is preferably capable of being pivoted so that the spool shaft 111 is in a substantially horizontal orientation. (FIG. 3). Second spool end drainage tile retaining member 113 is coupled to spool shaft receiving member 114, which is coupled to reaching support arm 120, which is coupled to upstanding frame member top portion 152, which is coupled to upstanding frame member bottom portion 150. Upstanding frame member bottom portion 150 having a bottom portion longitudinal axis and upstanding frame member top portion 152 having a top portion longitudinal axis which is substantially parallel with said bottom portion longitudinal axis. Upstanding frame member bottom portion 150 and upstanding frame member top portion 152 are configured in a nested telescoping arrangement, however other non-nested configurations are contemplated as well. Said bottom portion longitudinal axis is shown as being substantially vertical, but variations of this are also contemplated. Upstanding frame member top portion 152 is coupled to a powered telescoping actuator second portion 122, which is coupled to powered telescoping actuator first portion 121, which in combination may be a hydraulic cylinder or other powered linear actuator, such as a pneumatic cylinder or an electric or mechanical linear actuator or suitable substitute. When hydraulic pressure is applied to powered telescoping actuator second portion 122, it moves and forces upstanding frame member top portion 152 to telescope to an expanded configuration, such as is shown in FIG. 2. Also shown in FIG. 1 is a spool shaft receiving member side portion 1413 with a spool shaft receiving member first interior member 1411 and a spool shaft receiving member second interior member 1415. Spool shaft 111 is shown having a spool shaft top portion 1111 which is disposed between spool shaft receiving member second interior member 1415 and spool shaft receiving member first interior member 1411. Said spool shaft 111 having a substantially cylindrical intermediate portion disposed between said spool shaft top portion 1111 and a point of connection between first spool end drainage tile retaining member 112 and spool shaft 111.

Now referring to FIG. 2, there is shown view of the drainage tile stringing implement attachment 100 of the present invention with upstanding frame member top portion 152 being powered into an extended configuration with respect to upstanding frame member bottom portion 150. This results in the second spool end drainage tile retaining member 113 and spool shaft receiving member 114 being elevated above spool shaft top portion 1111. This cap raising step is done before the next step, which is shown in FIG. 3.

Now referring to FIG. 3, there is shown a coil engaging configuration where the spool shaft 111 is shown in a substantially horizontal configuration for insertion in a central opening of a coil of an agricultural drainage tile. First spool end drainage tile retaining member 112 is shown coupled to shaft supporting pivot arm 140 which is forced into a pivoted position by application of hydraulic pressure to powered pivoting actuator second portion 142, or the like, which is coupled to powered pivoting actuator first portion 141, or the like, which is coupled to a structural portion of drainage tile stringing implement attachment 100. This construction and function of the items described in these paragraphs may be, but need not be, similar to items performing similar functions in the above referenced US published patent application.

Figure 4:
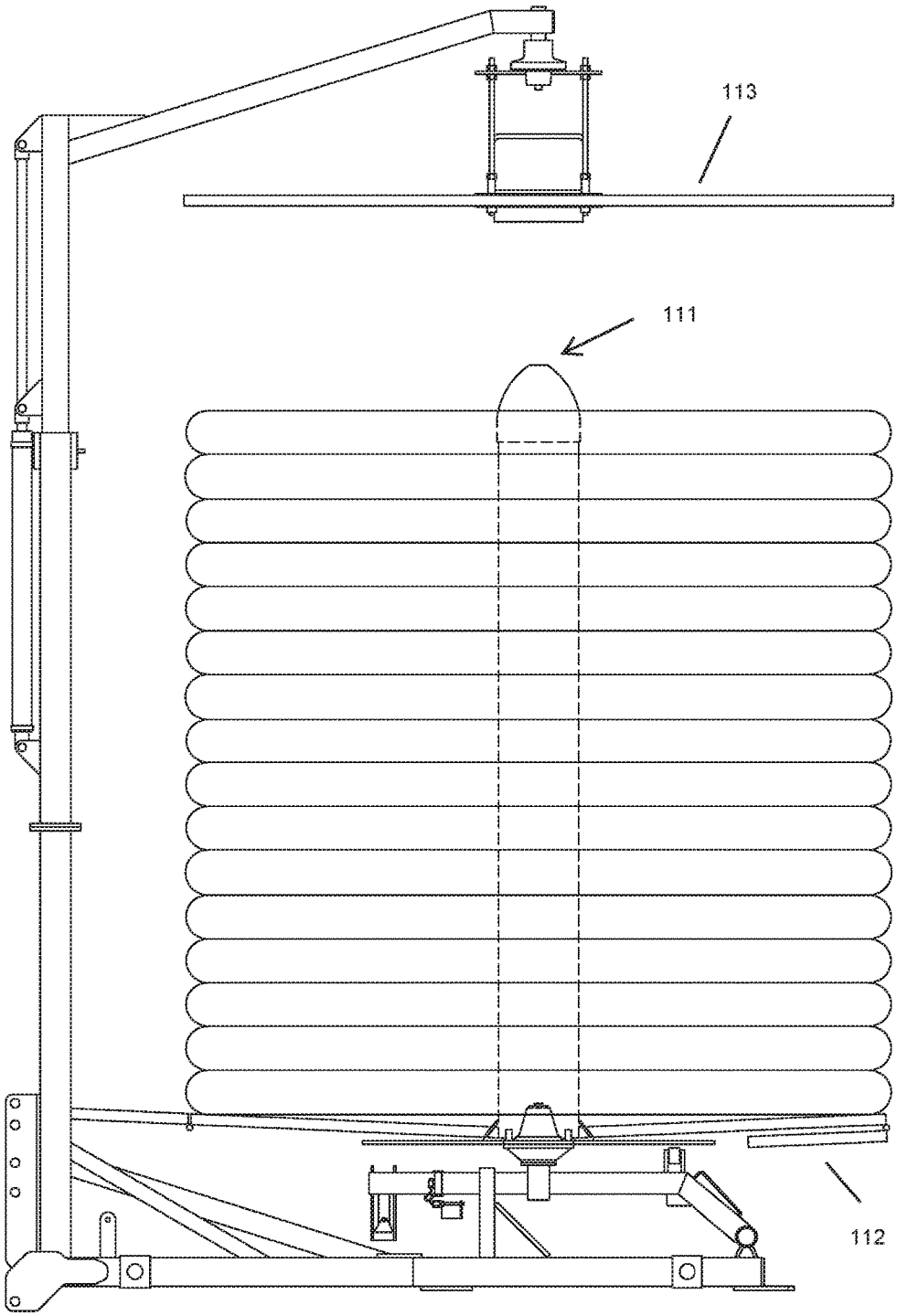
FIG. 4 is an elevation view of the drainage tile stringing implement attachment 100 of FIGS. 1-3, in a loaded and upright configuration.

Now referring to FIG. 4, there is shown a configuration of the drainage tile stringing implement attachment 100 which has been retracted into an uncapped and loaded configuration. Note that the powered pivoting actuator second portion 142 and powered pivoting actuator first portion 141 are omitted from this figure, but it should be understood that they were used in combination with each other to tip the coil of drainage tile into the shown orientation.

Figure 5:
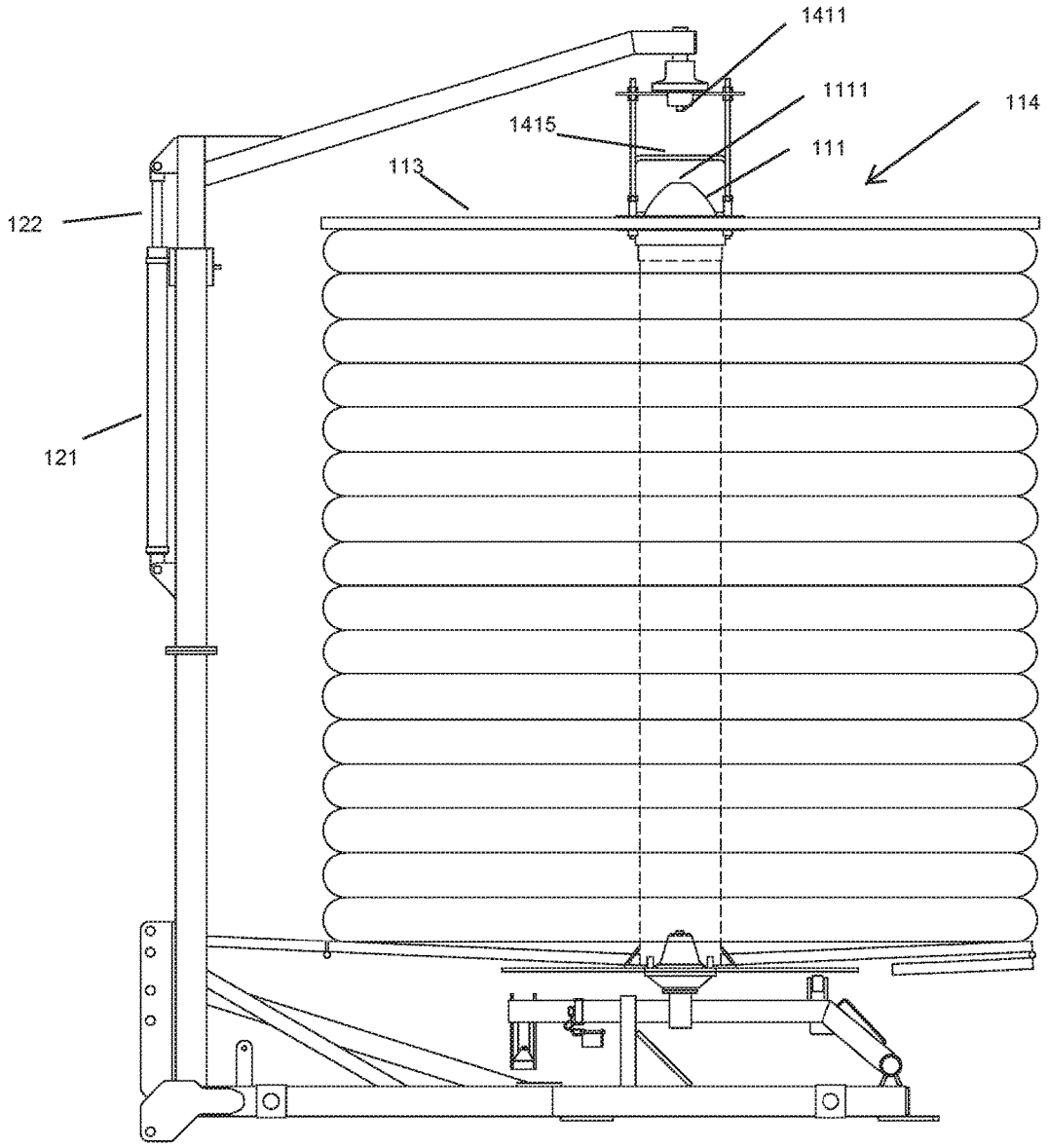
FIG. 5 is an elevation view of the drainage tile stringing implement attachment 100 of FIGS. 1-4, in a loaded, upright and capped configuration.

Now referring to FIG. 5, there is shown a configuration of the drainage tile stringing implement attachment 100 where the second spool end drainage tile retaining member 113 has been lowered by manipulation of powered telescoping actuator second portion 122 and powered telescoping actuator first portion 121 so that second spool end drainage tile retaining member 113 contacts the top portion of a coil of drainage tile disposed about spool shaft 111. It should be noted that spool shaft top portion 1111 is shown below spool shaft receiving member second interior member 1415, which is between spool shaft receiving member first interior member 1411 and spool shaft top portion 1111. This configuration shows that the second spool end drainage tile retaining member 113 is being prohibited from going down to the most compact configuration of FIG. 1 by the presence of the coil of drainage tile. As drainage tile is removed from the coil (depending on how it was wound and how the wound coil was oriented with respect to the spool shaft 111), a cap may appear between the second spool end drainage tile retaining member 113 and the top of the coil. In one embodiment of the present invention, the hydraulic pressure on powered telescoping actuator second portion 122 can be changed and upstanding frame member top portion 152 may be retracted into upstanding frame member bottom portion 150 and the gap could be reduced or eliminated. The spool shaft receiving member side portion 1413 in some embodiments might be longer so as to permit an extended range of penetration or variable depth of penetration of the spool shaft 111 into spool shaft receiving member 114. This ability to change the vertical height of the spool which is formed when second spool end drainage tile retaining member 113 is moved toward first spool end drainage tile retaining member 112 allows for a size characteristic of the spool to be adjustable and to thereby facilitate secure retention and use of partial coils of drainage tile and allows for reducing the space which might permit unwanted movement of the drainage tile within the drainage tile stringing implement attachment 100. The control of the precise location of the second spool end drainage tile retaining member 113, with respect to the spool shaft 111 could be left to the judgement of a human operator or vehicle drivers.

Figure 6:
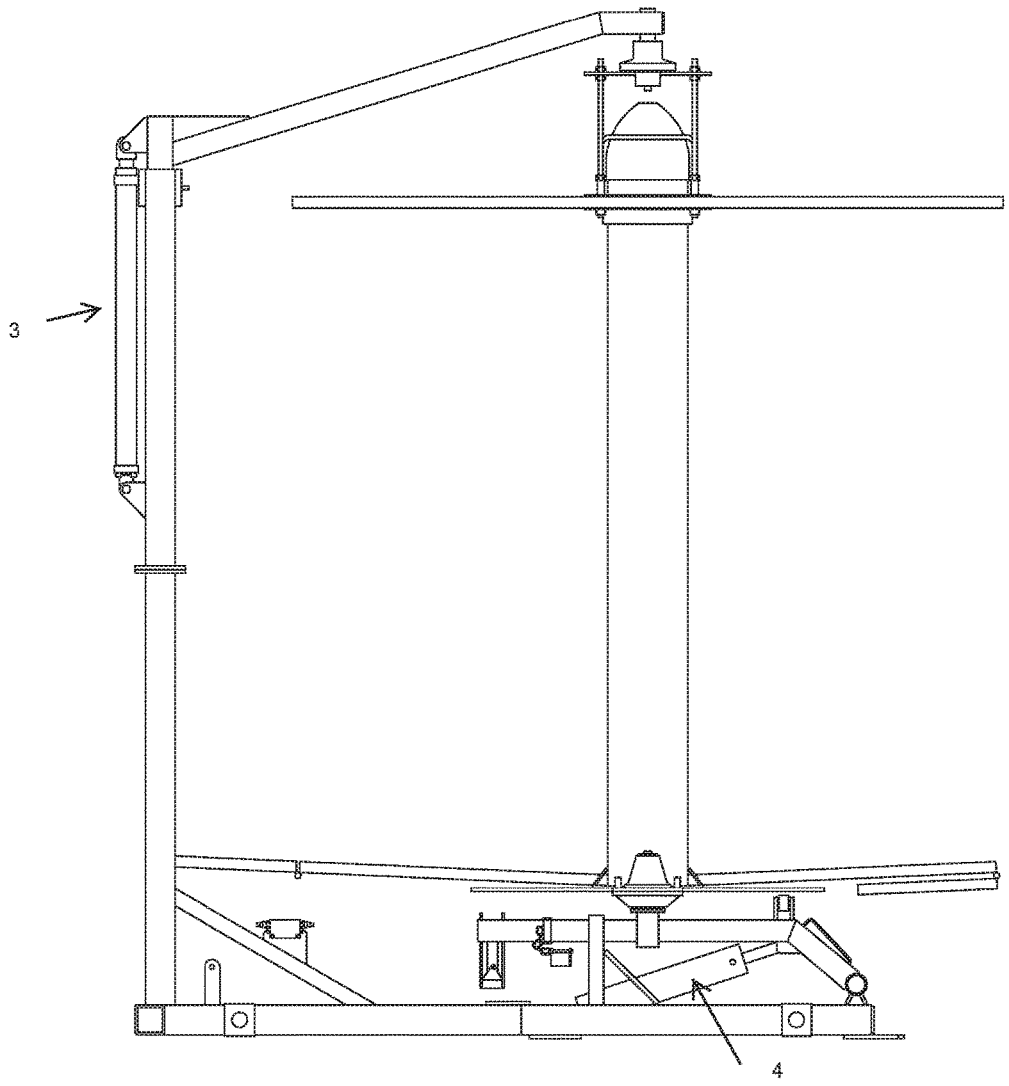
FIG. 6 is an alternate view of the system shown in FIGS. 1-5 with alternate numbering and additional numbering relating to the hydraulic portions of the present invention which are also shown in FIGS. 7-11.

Now referring to FIG. 6, there is shown an alternate view of the system shown in the position as shown in FIG. 1 with alternate numbering and additional numbering relating to the hydraulic portions of the present invention, which are also shown in FIGS. 7-11. More specifically, powered telescoping actuator first portion 121 and powered telescoping actuator second portion 122 are collectively labelled as hat lift cylinder 3 in FIG. 6. Similarly, powered pivoting actuator first portion 141 and powered pivoting actuator second portion 142 are collectively labeled as table lift cylinder 4 in FIG. 6. Note the table lift cylinder is not shown in FIGS. 1, 2, 4, and 5, but it should be understood that it would be present in an actual working embodiment of the present invention.

Figure 7:
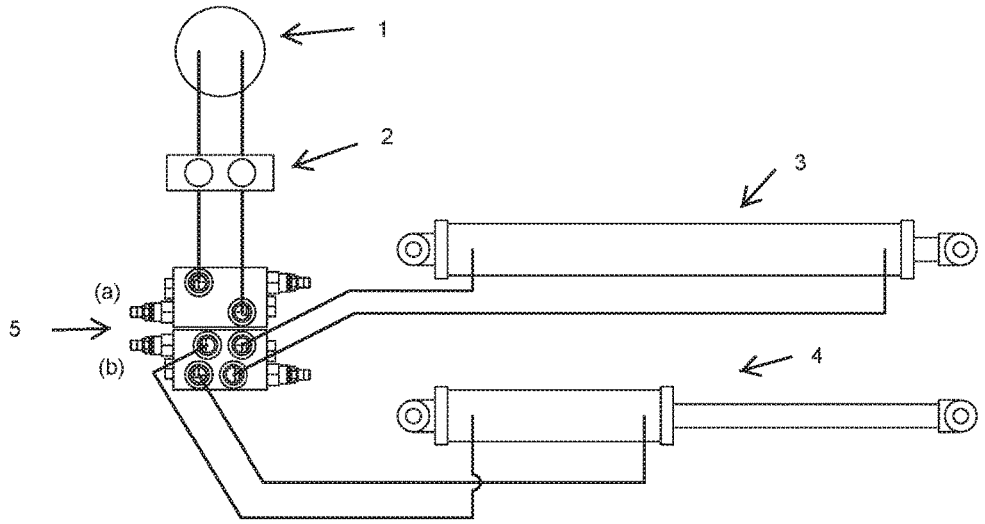
FIG. 7 is a hydraulic circuit diagram of an embodiment of the present invention.

Now referring to FIG. 7, there is a close up view of the hydraulic circuit of the present invention which includes a hydraulic pump 1, which could be powered by an Option A dc power unit, or an Option B tractor hydraulics or suitable substitutes. A hydraulic flow control push button control 2 (which could be disposed within reach of the driver of a vehicle and could be either electrical for Option A or a Tractor Valve if Option B). The Hat Lift Cylinder 3 and the Table Lift Cylinder 4 are also shown. Also shown is Sequencing Valve 5 with associated connections to button 2 and cylinders 3 and 4.

Figure 8:
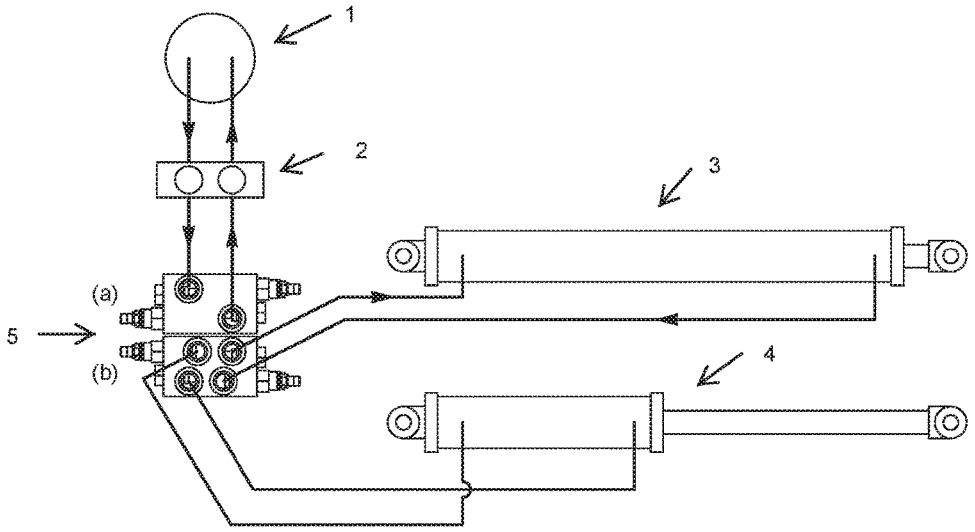
FIG. 8 is a hydraulic flow diagram which corresponds to the system configuration shown in FIG. 2, wherein the arrows represent the direction of fluid flow.

Now referring to FIG. 8, there is shown a hydraulic flow diagram which corresponds to the system configuration shown in FIG. 2, wherein the arrows represent the direction of fluid flow.

Figure 9:
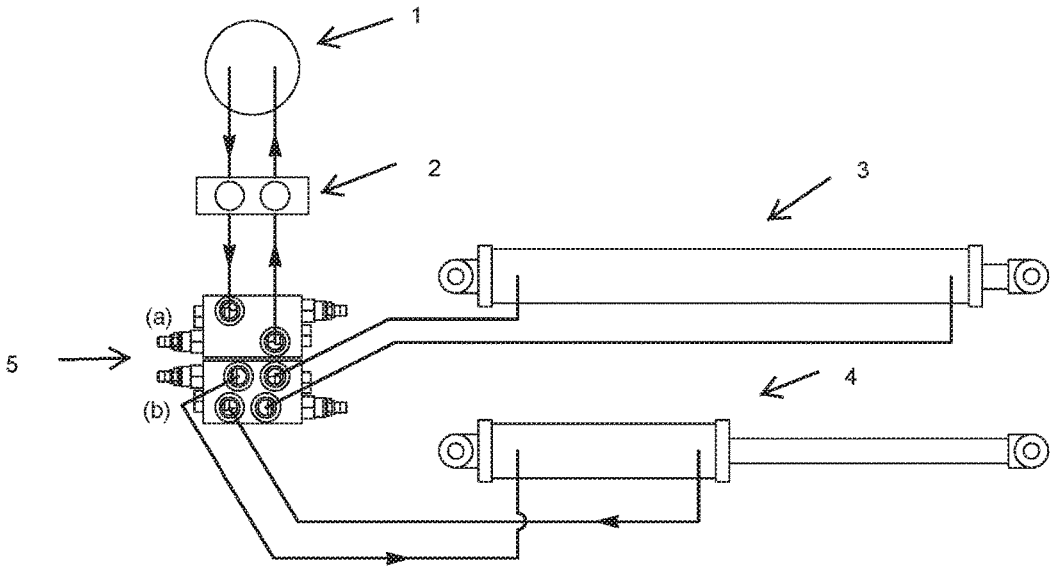
FIG. 9 is a hydraulic flow diagram which corresponds to the system configuration shown in FIG. 3, wherein the arrows represent the direction of fluid flow.

Now referring to FIG. 9, there is shown a hydraulic flow diagram which corresponds to the system configuration shown in FIG. 3, wherein the arrows represent the direction of fluid flow.

Figure 10:
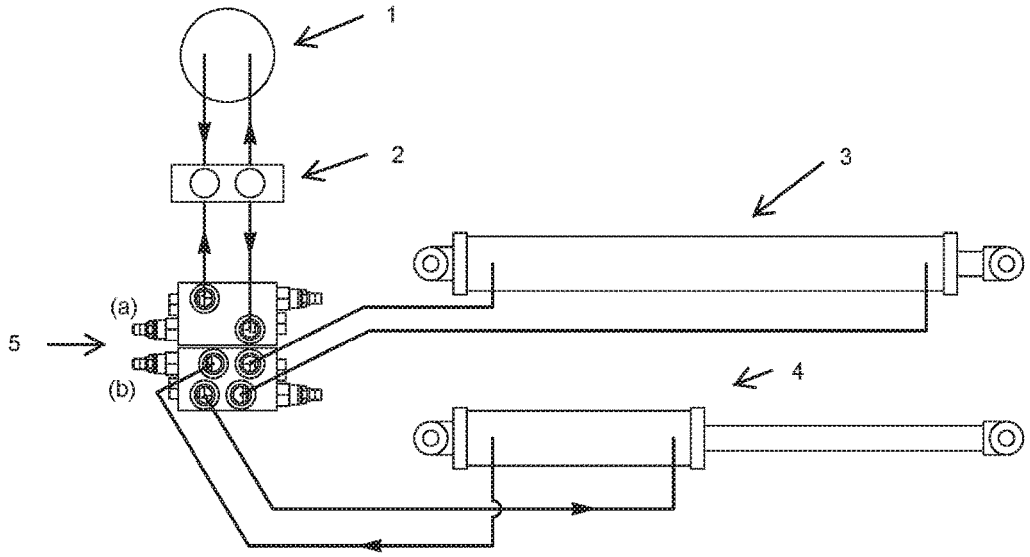
FIG. 10 is a hydraulic flow diagram which corresponds to the system configuration shown in FIG. 4, wherein the arrows represent the direction of fluid flow.

Now referring to FIG. 10, there is shown a hydraulic flow diagram which corresponds to the system configuration shown in FIG. 4, wherein the arrows represent the direction of fluid flow.

Figure 11:
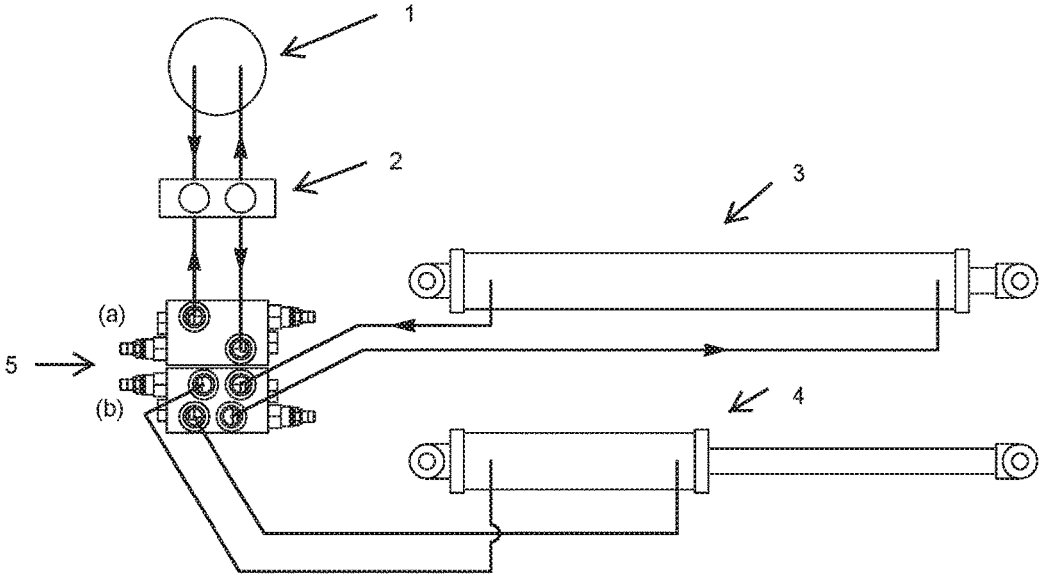
FIG. 11 is a hydraulic flow diagram which corresponds to the system configuration shown in FIG. 5, wherein the arrows represent the direction of fluid flow.

Now referring to FIG. 11, there is shown a hydraulic flow diagram which corresponds to the system configuration shown in FIG. 5, wherein the arrows represent the direction of fluid flow.

In operation, and now referring to FIGS. 1-5 and 8-11, the system of the present invention could function as follows: the system starts from a transport configuration with the spool empty and the second spool end drainage tile retaining member 113 seated as far down as possible (FIG. 1). Next the second spool end drainage tile retaining member 113 is raised up to allow for pivoting of the spool shaft 111 (FIGS. 2 and 8). Next the spool shaft 111 is pivoted to allow mating with a coil of drainage tile (FIGS. 3 and 9). Next the spool shaft 111 is pivoted upright (FIGS. 4 and 10). And lastly, the second spool end drainage tile retaining member 113 is lowered into close proximity of the top portion of the coil of drainage tile (FIGS. 5 and 11). From the tractor or truck seat, the operator while viewing the implement, manipulates the push button or lever to cycle the loading system. The cycle is stopped (at FIG. 3) to maneuver the spool shaft into the fresh coil. After the spool shaft and coil are fully engaged, the button or lever is actuated to continue the loading cycle.

At the end of the loading cycle, the operator can stop the capping process when 113 contacts the coil or then may continue lowering, thereby adding the desired down pressure or completely seats the cap, whichever comes first.

It should be understood that while this invention could have benefits of automated operation, many of the benefits of the invention could still be enjoyed with simple separate manual hydraulic controls for each hydraulic cylinder. Our automated sequencing not only simplifies the cycling process, it also protects the implement's components. Our system will not allow the table to pivot while the spool shaft (111) is engaged with 113 or allow the coil or 111 to contact the 113 while loading.

In the above description, it should be understood that the claimed means for translating might include only a linear actuator and some simple control mechanism. This could be a single hydraulic cylinder with a manual hydraulic controller, together with the required hoses, fluid, connections, and sources of hydraulic power. Alternatively, this means for translating could be electric and could be many different types of linear actuators, including, but not limited to, an electric motor and a treaded or toothed elongated member together with a simple switch, or suitable substitutes. Of course, the means for translating could include the system as shown in FIGS. 6-11.

It should be understood that when the terms vertical and horizontal are used to describe the present invention, it is not intended that these terms be interpreted to make them incorrect if the present invention is on a vehicle which is on uneven ground or inclined. The terms are meant to encompass such variations.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

I claim:

1. A method of adjusting a spool size for an amount of tile on a tile stringing implement attachment comprising the steps of:

a. providing an amount of an elongated tile, said amount having a first size characteristic;
b. providing a shaft oriented in a first direction and said amount being disposed about said shaft;
c. providing a first end tile retaining member, coupled to said shaft;
d. providing a second end tile retaining member;
e. providing a shaft receiving member coupled to said second end tile retaining member;
f. providing a support arm coupled to said second end tile retaining member;
g. providing a frame member bottom portion;
h. providing a frame member top portion, which is operatively coupled between said frame member bottom portion and support arm;
i. translating said one of said frame member bottom portion and frame member top portion with respect to another one of said frame member bottom portion and frame member top portion and in a second direction, which is not substantially perpendicular with said first direction;
j. stopping said step of translating after contact between said amount and said second end tile retaining member occurs;
k. removing a portion of said amount until a gap forms between said amount and said second end tile retaining member; and
l. resuming the step of translating and thereby adding a pressure on a portion said amount which remains between said first end tile retaining member and said second end tile retaining member to close said gap.

2. The method of claim 1 wherein said support arm is indirectly coupled to said second end tile retaining member via said shaft receiving member.

3. The method of claim 1 wherein said shaft receiving member is sized and configured to receive said shaft at variable depths of penetration.

4. The method of claim 3 wherein said step of translating is powered, at least in part, by a hydraulic pump.

5. The method of claim 1 wherein said step of stopping is performed manually by a human operator.

6. The method of claim 1 wherein said step of stopping is performed automatically without human interaction.

7. The method of claim 1 wherein said frame member bottom portion is an upstanding frame member bottom portion and said pressure is a downward pressure.

8. A system for stringing drainage tile comprising:

a. an amount of an elongated tubular structure; having a first size characteristic;
b. an adjustable member with an adjustable size characteristic, the adjustable member including:
   i. a shaft oriented in a first direction and said amount being disposed about said shaft;
   ii. a first end elongated tubular structure retaining member, coupled to said shaft;
   iii. a second end elongated tubular structure retaining member; and
   iv. a shaft receiving member coupled to said second end elongated tubular structure retaining member, said shaft receiving member including a shaft receiving member side portion which has a length characteristic which defines a range of said adjustable size characteristic;
c. a support arm coupled to said second end elongated tubular structure retaining member;
d. a frame member bottom portion;
e. a frame member top portion, which is operatively coupled between said frame member bottom portion and support arm;
f. means for applying a pressure on said amount of an elongated tubular structure by translating said one of said frame member bottom portion and frame member top portion with respect to another one of said frame member bottom portion and frame member top portion and in a second direction which is not substantially perpendicular with said first direction; and
g. said means for applying a pressure further is configured for continuing to translate and thereby applying a pressure on a portion of said amount of elongated tubular structure, which remains between said first end elongated tubular structure retaining member and said second end elongated tubular structure retaining member, after a portion of said amount of elongated tubular structure has been removed.

9. The system of claim 8 wherein said means for applying a pressure comprises a hydraulic cylinder and a means for hydraulic flow control.

10. The system of claim 9 wherein said means for hydraulic flow control is a push button control.

11. The system of claim 9 wherein said means for hydraulic flow control is automated so as to not require a driver of a vehicle to exit the vehicle.

12. A drainage tile stringing implement comprising:

a. a substantially upright member;

b. an adjustable spool with an adjustable height characteristic, the adjustable spool including:

i. a first spool end drainage tile retaining member sized and configured to retain a coil of agricultural drainage tile;

ii. a spool shaft, having a shaft longitudinal axis, coupled to said first spool end drainage tile retaining member;

iii. a detachable second spool end drainage tile retaining member, sized and configured to retain agricultural drainage tile; and iv. a spool shaft receiving member coupled to said detachable second spool end drainage tile retaining member; which is sized and configured to translate, along said shaft longitudinal axis, and over a top portion of said spool shaft and along an intermediate substantially cylindrical portion of said spool shaft; and v. said spool shaft receiving member including a spool shaft receiving member side portion which has a length characteristic which defines a range of said adjustable height characteristic;

c. said spool shaft pivotally coupled to said substantially upright member, so that said shaft longitudinal axis can pivot from a first direction to a second direction; where said first direction is not substantially parallel to said second direction;

d. a powered pivoting actuator coupled so as to lift said spool shaft and change said shaft longitudinal axis from said second direction to said first direction; and e. a linear actuator configured to continue to move said spool shaft receiving member along said shaft longitudinal axis, beyond a point where said detachable second spool end drainage tile retaining member first contacts said coil of agricultural drainage tile, to increase pressure on a remaining portion of said coil of agricultural drainage tile, after a portion of said agricultural drainage tile has been removed from between said first spool end drainage tile retaining member and said second spool end drainage tile retaining member.

13. The implement of claim 12 wherein said linear actuator comprises a hydraulic cylinder.

14. The implement of claim 13 wherein said powered pivoting actuator comprises a hydraulic cylinder.

15. The implement of claim 13 wherein said spool shaft is indirectly pivotally coupled to said substantially upright member through a shaft supporting pivot arm.

16. The implement of claim 15 further comprising a means for automating sequencing of fluid flows through several predetermined fluid flow paths.

* * * * *